US012559900B2

(12) United States Patent
Liu et al.

(10) Patent No.: US 12,559,900 B2
(45) Date of Patent: Feb. 24, 2026

(54) TURNTABLE ASSEMBLY AND ENGINEERING MECHANICAL EQUIPMENT

(71) Applicant: JIANGSU XCMG CONSTRUCTION MACHINERY RESEARCH INSTITUTE LTD., Xuzhou (CN)

(72) Inventors: Xiaocheng Liu, Xuzhou (CN); Yanbo Geng, Xuzhou (CN); Hongyu Zhang, Xuzhou (CN)

(73) Assignee: JIANGSU XCMG CONSTRUCTION MACHINERY RESEARCH INSTITUTE LTD., Xuzhou (CN)

( * ) Notice: Subject to any disclaimer, the term of this patent is extended or adjusted under 35 U.S.C. 154(b) by 261 days.

(21) Appl. No.: 18/546,307

(22) PCT Filed: Jan. 5, 2023

(86) PCT No.: PCT/CN2023/070685

§ 371 (c)(1),
(2) Date: Aug. 14, 2023

(87) PCT Pub. No.: WO2024/108745

PCT Pub. Date: May 30, 2024

(65) Prior Publication Data

US 2025/0019930 A1 Jan. 16, 2025

(30) Foreign Application Priority Data

Nov. 22, 2022 (CN) ..... 202211464243.1

(51) Int. Cl.
*E02F 3/38* (2006.01)
*E02F 9/00* (2006.01)
*E02F 9/12* (2006.01)

(52) U.S. Cl.
CPC ..... *E02F 3/384* (2013.01); *E02F 9/006* (2013.01); *E02F 9/125* (2013.01)

(58) Field of Classification Search
CPC ..... E02F 9/006; E02F 9/125
See application file for complete search history.

(56) References Cited

U.S. PATENT DOCUMENTS 3,664,515 A * 5/1972 Orendorff ..... B66C 23/94 212/292
3,739,652 A * 6/1973 Caldwell ..... E02F 9/121 212/175

(Continued)

FOREIGN PATENT DOCUMENTS

CN 201068578 Y 6/2008
CN 201647864 U 11/2010

(Continued)

OTHER PUBLICATIONS

Extended European Search Report from EP Application No. 23723106.3 dated Jan. 29, 2025.

(Continued)

*Primary Examiner* — Saul Rodriguez
*Assistant Examiner* — Brendan P Tighe
(74) *Attorney, Agent, or Firm* — Calfee, Halter & Griswold LLP

(57) ABSTRACT

The present disclosure relates to a turntable assembly and an engineering mechanical equipment. A turntable assembly for an engineering mechanical equipment includes: a turntable body; a first rotating mechanism connected to the turntable body and configured to cause the turntable body to rotate relative to an undercarriage of the engineering mechanical equipment; and a second rotating mechanism connected to the turntable body and configured to cause an upper work device of the engineering mechanical equipment to rotate relative to the turntable body. An axis of rotation of the first rotating mechanism is not co-linear with an axis of rotation of the second rotating mechanism. The second rotating mechanism includes a rotating body for connecting the (Continued)

upper work device. At least two hinge points arranged spaced apart along the axis of rotation of the second rotating mechanism are provided between the rotating body and the turntable body.

16 Claims, 6 Drawing Sheets

(56) References Cited

U.S. PATENT DOCUMENTS

| | | | | |
|---|---|---|---|---|
| 6,199,442 | B1 * | 3/2001 | Bauer | E02F 9/121 212/292 |
| 6,799,753 | B2 | 10/2004 | Okanaka et al. | |
| 8,668,041 | B2 * | 3/2014 | Yumoto | E02F 9/0833 414/744.2 |
| 8,855,872 | B2 * | 10/2014 | Yamazaki | E02F 9/2075 180/65.265 |
| 8,881,519 | B2 * | 11/2014 | Kamimura | E02F 9/2228 60/414 |
| 9,004,217 | B2 * | 4/2015 | Okumura | E02F 9/20 180/291 |
| 9,422,691 | B2 * | 8/2016 | Ueta | E02F 9/123 |
| 9,828,049 | B2 * | 11/2017 | Lyle | E02F 9/08 |
| 10,260,214 | B2 * | 4/2019 | Rutherford | E02F 9/123 |
| 2003/0075848 | A1 | 4/2003 | Okanaka et al. | |
| 2016/0319513 | A1 * | 11/2016 | Chen | E02F 9/024 |
| 2016/0332849 | A1 | 11/2016 | Roodenburg et al. | |
| 2021/0079619 | A1 * | 3/2021 | Masuda | E02F 9/006 |

FOREIGN PATENT DOCUMENTS

| | | | |
|---|---|---|---|
| CN | 201801894 | U | 4/2011 |
| CN | 202295044 | U | 7/2012 |
| CN | 202338536 | U | 7/2012 |
| CN | 203090321 | U | 7/2013 |
| CN | 206051358 | U | 3/2017 |
| CN | 107882098 | A | 4/2018 |
| CN | 110453735 | A | 11/2019 |
| CN | 111042259 | A | 4/2020 |
| CN | 210683029 | U | 6/2020 |
| CN | 113651254 | A | 11/2021 |
| CN | 219298319 | U | 7/2023 |
| EP | 0806525 | A2 | 11/1997 |
| EP | 2241530 | A1 | 10/2010 |
| EP | 2241530 | B1 | 7/2013 |
| EP | 2611724 | B1 | 10/2014 |
| EP | 3805467 | A1 | 4/2021 |
| JP | H068458 | U | 2/1994 |
| JP | H06294143 | A | 10/1994 |
| JP | 2003176548 | A | 6/2003 |
| KR | 10-19980079227 | A | 11/1998 |
| WO | 2005043976 | A1 | 5/2005 |
| WO | 2013044620 | A1 | 4/2013 |

OTHER PUBLICATIONS

Office Action from CN Application No. 202211464243.1 dated Apr. 17, 2025.

International Search Report and Written Opinion from PCT/CN2023/070685 dated Aug. 8, 2023.

* cited by examiner

TURNTABLE ASSEMBLY AND ENGINEERING MECHANICAL EQUIPMENT

CROSS-REFERENCE TO RELATED APPLICATIONS

This application is a U.S. National Stage Application under 35 U.S.C. § 371 of International Patent Application No. PCT/CN2023/070685, filed on Jan. 5, 2023, which is based on and claims priority to CN application No. 202211464243.1, filed on Nov. 22, 2022, the disclosures of which are hereby incorporated by reference in their entirety.

TECHNICAL FIELD

The present disclosure relates to the field of engineering machinery, in particular to a turntable assembly and an engineering mechanical equipment.

BACKGROUND

A turntable is an important component of engineering machinery such as excavators. In some related technologies, the center of the turntable is provided with a main rotating mechanism, and a work device is fixed in position relative to the turntable. The work device is generally long, resulting in that the work device protrudes much from the turntable, such that on one hand, a whole machine vehicle body is long and it is inconvenient during transfer and transport; on the other hand, at some work sites which are narrow and small, the protruding work device makes the turntable unable to slew normally. In related technologies, there are also some multi-functional engineering machines such as backhoe loaders that have started to work using a turntable, and a protruding work device interferes with a loading part at a front end during rotating such that normal operations cannot be carried out.

SUMMARY

In view of this, embodiments of the present disclosure provide a turntable assembly and an engineering mechanical equipment, which can facilitate transfer and transport of equipment.

In an aspect of the present disclosure, a turntable assembly for an engineering mechanical equipment is provided, including: a turntable body; a first rotating mechanism connected to the turntable body and configured to cause the turntable body to rotate relative to an undercarriage of the engineering mechanical equipment; and a second rotating mechanism connected to the turntable body and configured to cause an upper work device of the engineering mechanical equipment to rotate relative to the turntable body, wherein an axis of rotation of the first rotating mechanism is not co-linear with an axis of rotation of the second rotating mechanism; the second rotating mechanism includes a rotating body for connecting the upper work device; and at least two hinge points arranged spaced apart along the axis of rotation of the second rotating mechanism are provided between the rotating body and the turntable body.

In some embodiments, the turntable assembly further includes: a first fixing plate located on a top plate of the turntable body and fixed relative to the turntable body; and a second fixing plate located on an upper side of the first fixing plate and fixed relative to the turntable body, wherein the rotating body is connected to the first fixing plate and the second fixing plate respectively by means of hinge shafts, and the rotating body is in surface contact with the first fixing plate.

In some embodiments, the top plate has a first fixing hole, and the first fixing plate has a second fixing hole aligned with a center of the first fixing hole; and the second rotating mechanism further includes a rotating pin shaft, which passes through the first fixing hole and the second fixing hole and is fixedly connected to the rotating body by means of a locking pin, so that the rotating body is caused to rotate by rotation of the rotating pin shaft.

In some embodiments, the second rotating mechanism further includes a slewing driver, which is located on a side of the top plate away from the first fixing plate, a base of the slewing driver is fixedly connected to the first fixing plate or the top plate, and a rotating bearing of the slewing driver is fixedly connected to the rotating pin shaft.

In some embodiments, the turntable assembly further includes: a first rib plate fixedly connected to the top plate; and a second rib plate fixedly connected to the top plate, wherein the first rib plate and second rib plate are located on two sides of the first fixing hole respectively.

In some embodiments, the second fixing plate is fixedly connected to a side wall of the first rib plate adjacent to the first fixing hole.

In some embodiments, the rotating body includes: a rotating seat having a mounting hole for inserting the rotating pin shaft and a bottom in surface contact with the first fixing plate; and paired lug plates formed integrally with the rotating seat, wherein the second fixing plate is located between the paired lug plates and is articulated to the paired lug plates.

In some embodiments, the bottom of the rotating seat has a circumferential flange, and the diameter of the circumferential flange is larger than that of the first fixing plate.

In some embodiments, the first fixing plate is fixedly connected to the top plate.

In some embodiments, the turntable assembly further includes: a pressing mechanism arranged on the turntable body and configured to press the rotating body against a surface of the first fixing plate so that the rotating body remains in surface contact with the first fixing plate when rotating relative to the first fixing plate.

In some embodiments, the second rotating mechanism further includes a rotating pin shaft, which is fixedly connected to the rotating body by means of a locking pin, so that the rotating body is caused to rotate by rotation of the rotating pin shaft, wherein the pressing mechanism includes: a plurality of pressing pin shafts connected to the rotating pin shaft; and a plurality of pressing oil cylinders located on a side of the top plate of the turntable body away from the rotating body and respectively connected to the plurality of pressing pin shafts, and configured to respectively cause the plurality of pressing pin shafts to move by movement of piston rods, so that the rotating pin shaft applies an acting force toward the first fixing plate on the rotating body, through the locking pin.

In some embodiments, the rotating body includes a rotating seat, which has a bottom in surface contact with the first fixing plate, and a bottom of the rotating seat has a circumferential flange, wherein the pressing mechanism includes: an oil cylinder mounting bracket arranged on the top plate of the turntable body; and a plurality of pressing oil cylinders mounted on the oil cylinder mounting bracket configured and to press the circumferential flange downward by movement of piston rods.

In some embodiments, the plurality of pressing oil cylinders are arranged at equal angular intervals along a circumferential direction of the turntable body.

In some embodiments, the turntable assembly further includes: a locking mechanism arranged on the turntable body and configured to lock the rotating body at at least one rotational position.

In some embodiments, the locking mechanism includes a hydraulic oil cylinder locking mechanism and/or a mechanical locking mechanism.

In some embodiments, the hydraulic oil cylinder locking mechanism includes a locking oil cylinder arranged on a side of the top plate of the turntable body away from the rotating body, the rotating body has at least one locking hole, and the locking oil cylinder is configured to implement inserted fixation of the at least one locking hole by movement of a piston rod.

In some embodiments, the mechanical locking mechanism includes a locking plate, a spring, a fixing pin shaft and a flexible shaft drawstring, wherein the locking plate is articulated to the top plate by the fixing pin shaft, the spring is connected between the locking plate and the top plate, for resetting the locking plate to a position of abutting against the rotating body to achieve positional locking of the rotating body, and the flexible shaft drawstring is connected to the locking plate, for dragging the locking plate to rotate around the fixing pin shaft when subjected to a pulling force, so that the locking plate leaves the position of abutting against the rotating body to release the positional locking of the rotating body.

In some embodiments, a distance from the axis of rotation of the first rotating mechanism to a center of the turntable body is less than a distance from the axis of rotation of the second rotating mechanism to the center of the turntable body.

In an aspect of the present disclosure, engineering mechanical equipment is provided, including the turntable assembly described above.

In some embodiments, the engineering mechanical equipment is an excavator, a crane or a backhoe loader.

Therefore, according to embodiments of the present disclosure, the first rotating mechanism causes the turntable body to rotate relative to the undercarriage, and the second rotating mechanism causes the upper work device to rotate relative to the undercarriage, and the axis of rotation of the first rotating mechanism is not co-linear with the axis of rotation of the second rotating mechanism, such a dual-rotating-mechanism turntable assembly allows the work device to be rotated to the rear during transfer, such that the work device does not protrude from a vehicle body and the length of the vehicle body is greatly reduced, thereby facilitating transfer and transport of the equipment. This also enables the engineering mechanical equipment to operate in narrow working conditions such as in urban alleys. Providing the at least two hinge points arranged spaced apart along the axis of rotation of the second rotating mechanism between the rotating body of the second rotating mechanism and the turntable body can make the second rotating mechanism stronger and enable the work device to be operated under a high load or impact force.

BRIEF DESCRIPTION OF THE DRAWINGS

The drawings constituting a part of the specification describe embodiments of the present disclosure, and together with the specification, serve to explain the principle of the present disclosure.

With reference to the accompanying drawings, the present disclosure can be understood more clearly according to the following detailed description, in which.

It should be appreciated that the sizes of various parts shown in the drawings are not drawn in accordance with actual proportional relationships. In addition, same or similar reference numerals represent same or similar components.

DETAILED DESCRIPTION

Various exemplary embodiments of the present disclosure will now be described in detail with reference to the accompanying drawings. The description of the exemplary embodiments is only illustrative, and in no way serves as any limitation on the present disclosure and its application or use. The present disclosure can be implemented in many different forms and is not limited to the embodiments described herein. These embodiments are provided to make the present disclosure thorough and complete and to express fully the scope of the present disclosure to those skilled in the art. It is to be noted that unless specifically stated otherwise, the relative arrangement of components and steps, material components, numerical expressions and numerical values set forth in these embodiments should be construed as merely exemplary, rather than as limitations.

The words "first", "second" and the like used in present disclosure do not indicate any order, quantity or importance, but are only used to distinguish different parts. The word "comprise" or "include" or the like means that an element preceding the word covers listed elements following the word, and does not exclude the possibility of also covering other elements. The words "up", "down", "left", "right" and the like are only used to indicate a relative positional relationship. When the absolute position of a described object changes, the relative positional relationship may also change accordingly.

In the present disclosure, when a particular device is described to be located between a first device and a second device, there may or may not be an intermediate device between the particular device and the first device or the second device. When a particular device is described to be connected to another device, the particular device may be directly connected to the another device without an intermediate device, or it may be not directly connected to the other device but there is an intermediate device.

All terms (including technical or scientific terms) used in the present disclosure have the same meaning as understood by those of ordinary skill in the field of the present disclosure, unless otherwise defined specifically. It should also be understood that terms such as those defined in generic dictionaries should be understood to have meanings consistent with their meanings in the context of the related art, and should not be construed in an idealized or overly formalized sense, unless so defined explicitly herein.

Technologies, methods, and equipment known to those of ordinary skill in the related art may be not discussed in detail, but where appropriate, the technologies, methods, and equipment should be regarded as part of the specification.

Figure 1:
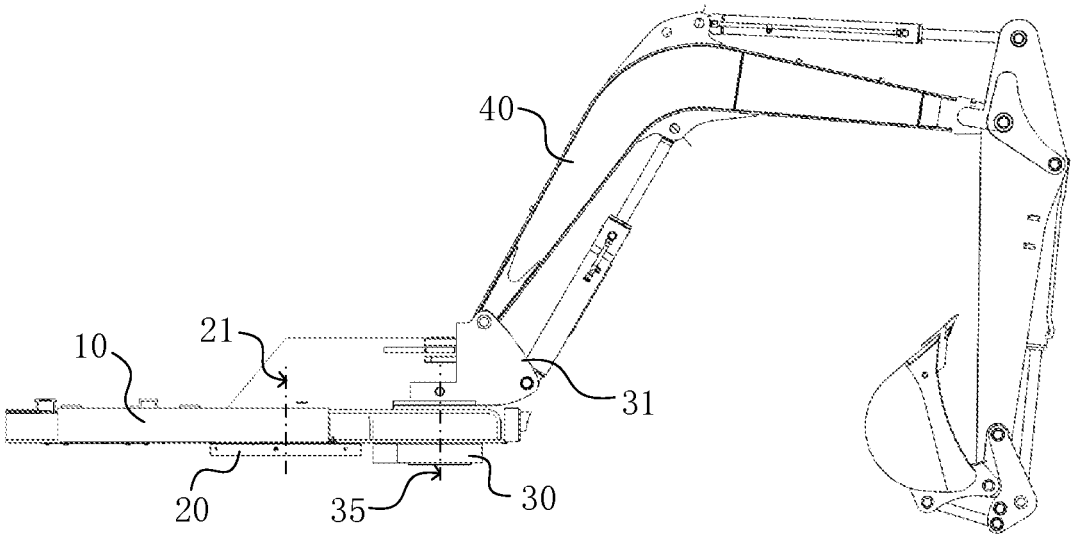
FIG. 1 is a structural diagram of an application of some embodiments of a turntable assembly according to the present disclosure.

FIG. 1 is a structural diagram of an application of some embodiments of a turntable assembly according to the present disclosure. Referring to FIG. 1, embodiments of the present disclosure provide a turntable assembly for an engineering mechanical equipment, including: a turntable body 10, a first rotating mechanism 20, and a second rotating mechanism 30. The first rotating mechanism 20 is connected to the turntable body 10 and is configured to cause the turntable body 10 to rotate relative to an undercarriage of the engineering mechanical equipment. Here the undercarriage of the engineering mechanical equipment can be an automobile chassis, a crawler chassis, or an annular rail fixed on the ground.

The second rotating mechanism 30 is connected to the turntable body 10 and is configured to cause an upper work device 40 of the engineering mechanical equipment to rotate relative to the turntable body 10. Here the upper work device 40 of the engineering mechanical equipment can include a crane boom, an excavator arm, or the like.

An axis of rotation 21 of the first rotating mechanism 20 is not co-linear with an axis of rotation 35 of the second rotating mechanism 30. Such a dual-rotating-mechanism turntable assembly allows the work device to be rotated to the rear during transition, such that the work device does not protrude from a vehicle body and the length of the vehicle body is greatly reduced, thereby facilitating transition and transport of the equipment. This also enables the engineering mechanical equipment to operate in narrow working conditions such as in urban alleys.

In some embodiments, a distance from the axis of rotation 21 of the first rotating mechanism 20 to a center of the turntable body 10 is less than a distance from the axis of rotation 35 of the second rotating mechanism 30 to the center of the turntable body 10. That is, the first rotating mechanism 20 is closer to the center of the turntable body 10 than the second rotating mechanism 30. This is conducive to reducing the size of the engineering mechanical equipment.

The second rotating mechanism 30 includes a rotating body 31 for connecting the upper work device 40, and at least two hinge points arranged spaced apart along the axis of rotation 35 of the second rotating mechanism 30 are provided between the rotating body 31 and the turntable body 10. Providing the at least two hinge points arranged spaced apart along the axis of rotation of the second rotating mechanism between the rotating body of the second rotating mechanism and the turntable body can make the second rotating mechanism stronger and enable the work device to carry out operations under a high load or impact force.

Figure 2:
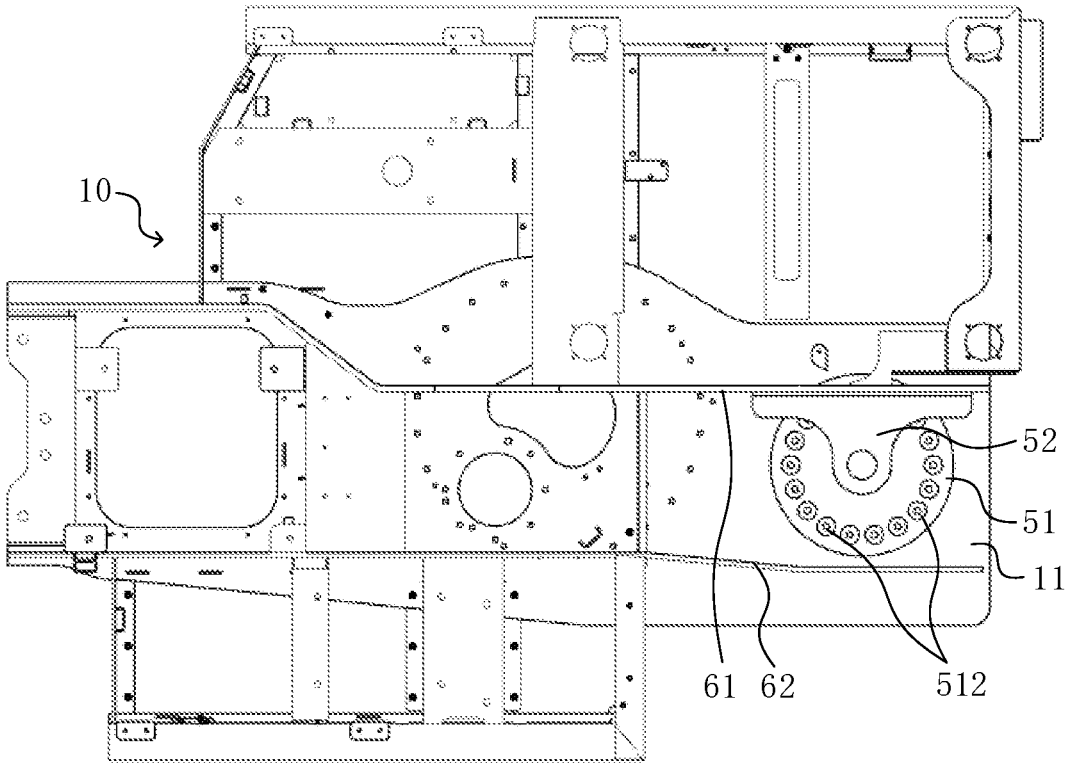
FIG. 2 is a schematic diagram of a turntable body and structures provided thereon in some embodiments of a turntable assembly according to the present disclosure.
Figure 3:
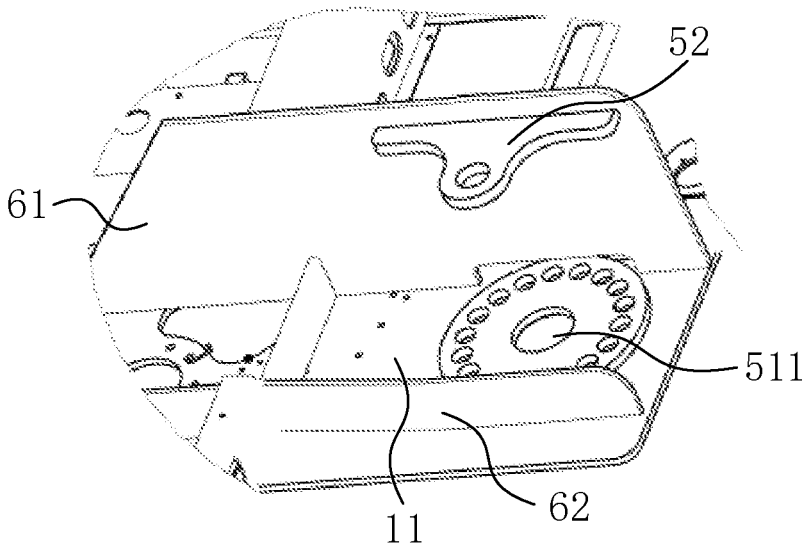
FIG. 3 is a partial structural diagram of an area where a second rotating mechanism is located in some embodiments of a turntable assembly according to the present disclosure.
Figure 4:
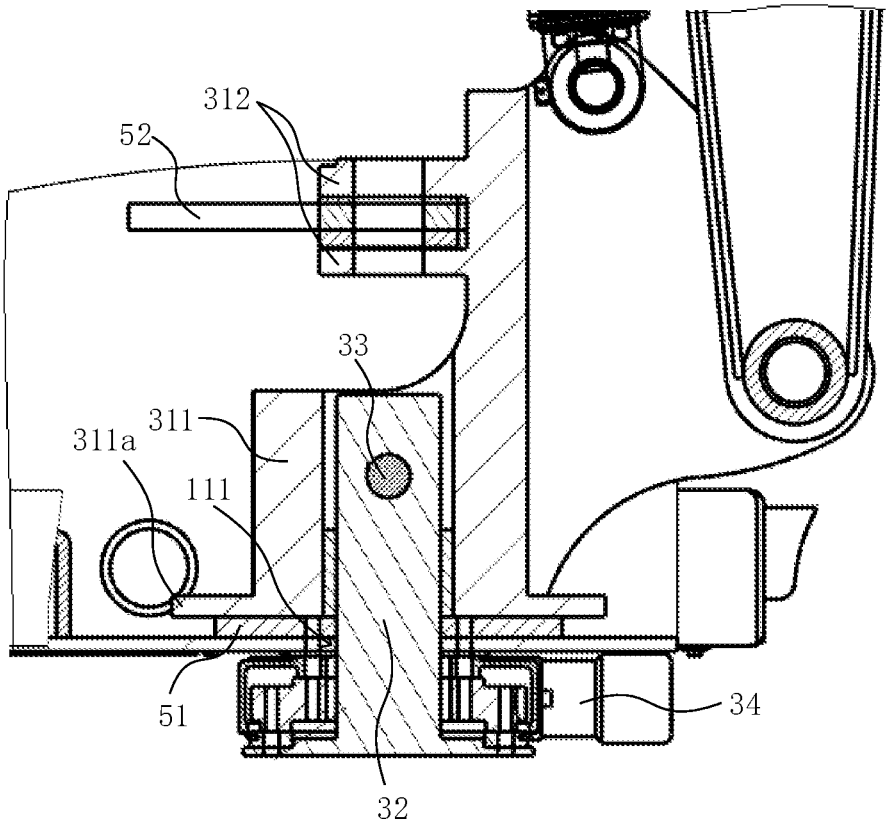
FIG. 4 is a cross-sectional diagram of mounting structures of a second rotating mechanism and a turntable body in some embodiments of a turntable assembly according to the present disclosure.
Figure 5:
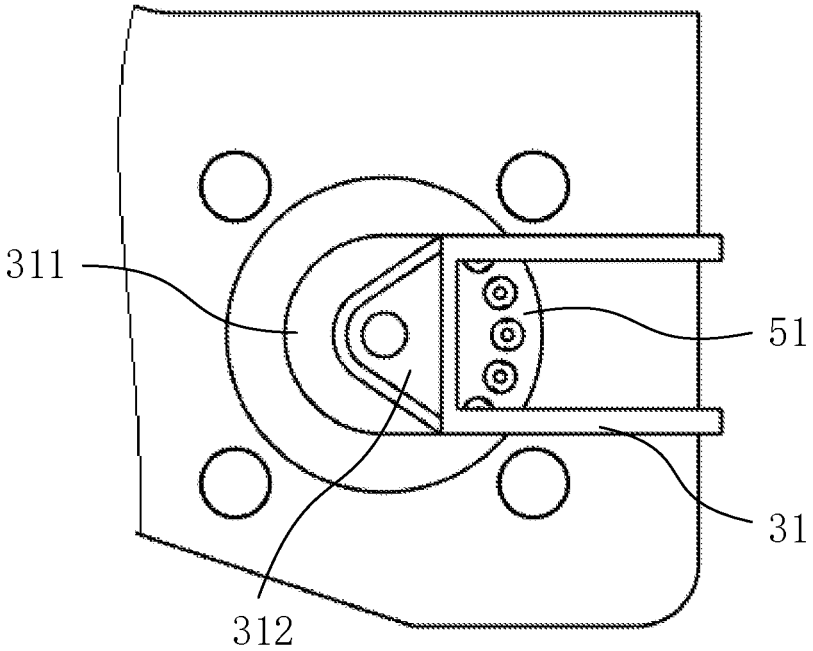
FIG. 5 is a schematic diagram of mounting structures of a second rotating mechanism and a turntable body in some embodiments of a turntable assembly according to the present disclosure at a top-view angle.

FIG. 2 is a schematic diagram of a turntable body and structures provided thereon in some embodiments of a turntable assembly according to the present disclosure. FIG. 3 is a partial structural diagram of an area where a second rotating mechanism is located in some embodiments of a turntable assembly according to the present disclosure. FIG. 4 is a cross-sectional diagram of mounting structures of a second rotating mechanism and a turntable body in some embodiments of a turntable assembly according to the present disclosure. FIG. 5 is a schematic diagram of mounting structures of a second rotating mechanism and a turntable body in some embodiments of a turntable assembly according to the present disclosure at a top-view angle.

Referring to FIGS. 2 to 5, in some embodiments, the turntable assembly further includes a first fixing plate 51 and a second fixing plate 52. The first fixing plate 51 is located on a top plate 11 of the turntable body 10 and is fixed relative to the turntable body 10. The second fixing plate 52 is located on an upper side of the first fixing plate 51 and is fixed relative to the turntable body 10. The rotating body 31 is connected to the first fixing plate 51 and the second fixing plate 52 respectively by means of hinge shafts, and the rotating body 31 is in surface contact with the first fixing plate 51.

By causing the rotating body 31 to be in surface contact with the first fixing plate 51 and connecting the rotating body 31 to the first fixing plate 51 and the second fixing plate 52 respectively by means of hinge shafts, the second rotating mechanism can have more strength, and the contact fit between the plane of the rotating body and the first fixing plate 51 enables forces thereon to be more uniform.

Referring to FIGS. 3 and 4, in some embodiments, the top plate 11 has a first fixing hole 111, and the first fixing plate 51 has a second fixing hole 511 aligned with a center of the first fixing hole 111. The second rotating mechanism 30 further includes a rotating pin shaft 32. The rotating pin shaft 32 passes through the first fixing hole 111 and the second fixing hole 511 and is fixedly connected to the rotating body 31 by means of a locking pin 33, so that the rotating body 31 is caused to rotate by rotation of the rotating pin shaft 32.

In FIG. 3, the first fixing plate 51 can be fixedly connected to an upper surface of the top plate 11 by means of a plurality of bolts or other connectors to increase the stability of the first fixing plate 51, thereby ensuring the rotating stability of the rotating body 31 in plane contact therewith.

The first fixing plate 51 has a flat surface, which can be in contact with a surface of a bottom end of the rotating body 31 to provide a more stable and reliable support function, and be slidable relative to the surface of a bottom end of the rotating body 31. The rotating pin shaft 32 passes through the first fixing hole 111 of the top plate 11 and the second fixing hole 511 of the first fixing plate 51, and penetrates into a mounting hole of the rotating body 31. The locking pin 33 passes through a hole wall of the mounting hole and a hole in the rotating pin shaft 32, thereby achieving fixed connection between the locking pin 33 and the rotating body 31. A sleeve can be provided between the rotating pin shaft 32 and the mounting hole so that the rotational fit therebetween is more stable.

Referring to FIG. 4, in some embodiments, the second rotating mechanism 30 further includes a slewing driver 34.

The slewing driver 34 is located on a side of the top plate 11 away from the first fixing plate 51, a base of the slewing driver 34 is fixedly connected to the first fixing plate 51 or the top plate 11, and a rotating bearing of the slewing driver 34 is fixedly connected to the rotating pin shaft 32. Since the slewing driver is arranged on the lower side of the top plate 11, the slewing driver hardly carries support force and impact force, which greatly increases its service life.

In some embodiments, the slewing driver 34 can include the base, a motor, a worm and the rotating bearing. The motor and the worm are arranged on the base. The motor can drive the worm to rotate, and drive the rotating bearing to rotate through the rotation of the worm, thereby causing the rotating pin shaft 32 to rotate.

Referring to FIGS. 2 to 4, in some embodiments, the turntable assembly further includes a first rib plate 61 and a second rib plate 62. The first rib plate 61 is fixedly connected to the top plate 11, and the second rib plate 62 is fixedly connected to the top plate 11. The first rib plate 61 and second rib plate 62 are located on two sides of the first fixing hole 111. Providing the first rib plate 61 and the second rib plate 52 on two sides of the first fixing hole 111 can effectively improve the strength of the position that the first fixing hole 111 is located at, thereby improving the strength of the second rotating mechanism, which can achieve a greater load-bearing moment and impact resistance.

Referring to FIG. 3, in some embodiments, the second fixing plate 52 is fixedly connected to a side wall of the first rib plate 61 adjacent to the first fixing hole 111. This allows the second fixing plate 52 to be stably and reliably arranged at a position above the first fixing plate 51.

Referring to FIGS. 4 and 5, in some embodiments, the rotating body 31 includes a rotating seat 311 and paired lug plates 312. The rotating seat 311 has a mounting hole for inserting the rotating pin shaft 32 and a bottom in surface contact with the first fixing plate 51. The paired lug plates 312 are made integrally with the rotating seat 311. The paired lug plates 312 can include one pair of lug plates 312, and can also include a plurality of pairs of lug plates 312. The second fixing plate 52 is located between the paired lug plates 312 and is articulated to the paired lug plates 312.

In order to cause the rotating of the rotating body 31 to be more stable, referring to FIG. 4, in some embodiments, the bottom of the rotating seat 311 has a circumferential flange 311*a*, and the diameter of the circumferential flange 311*a* is larger than that of the first fixing plate 51. The circumferential flange 311*a* can be a full-ring structure provided outside the rotating seat 311, and can also be a half-ring or more-than-half-ring structure provided outside the rotating seat 311.

Figure 6:
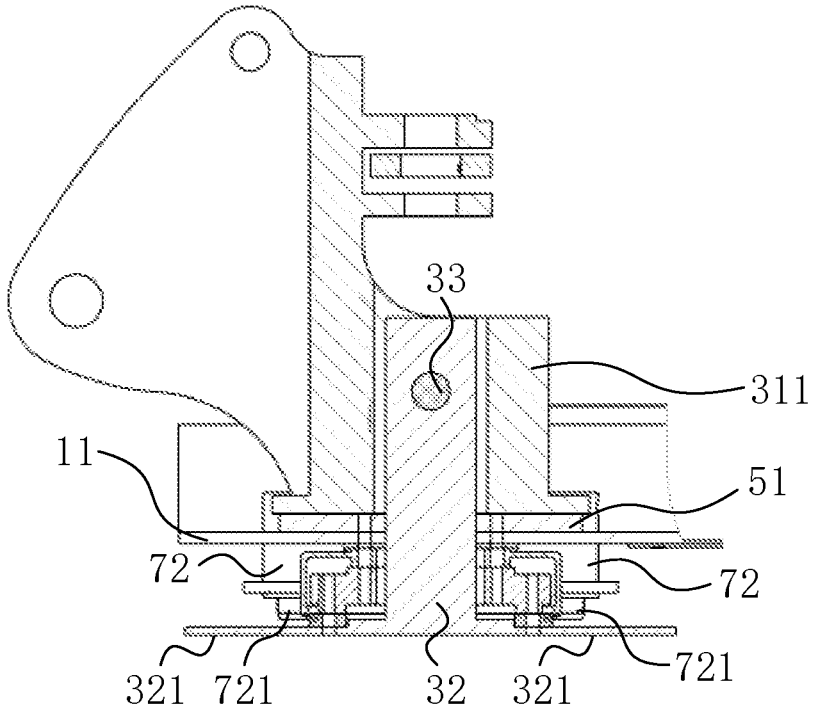
FIG. 6 is a structural diagram of a pressing mechanism in some embodiments of a turntable assembly according to the present disclosure.
Figure 7:
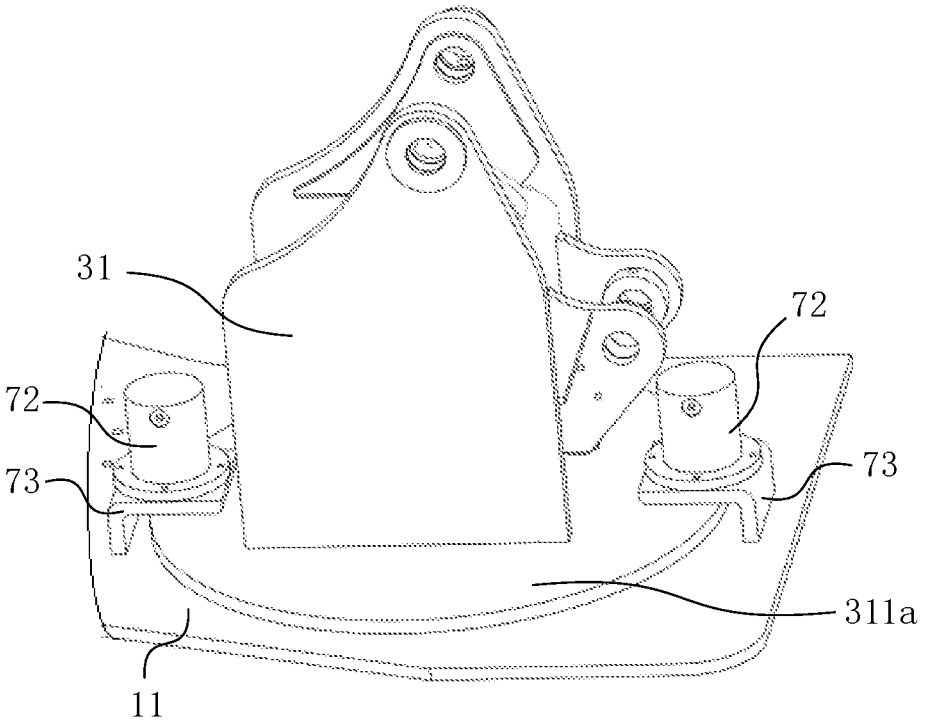
FIG. 7 is a structural diagram of a pressing mechanism in some other embodiments of a turntable assembly according to the present disclosure.

FIG. 6 is a structural diagram of a pressing mechanism in some embodiments of a turntable assembly according to the present disclosure. FIG. 7 is a structural diagram of a pressing mechanism in some other embodiments of a turntable assembly according to the present disclosure. Referring to FIGS. 6 and 7, in some embodiments, the turntable assembly further includes a pressing mechanism. The pressing mechanism is arranged on the turntable body 10 and is configured to press the rotating body 31 against a surface of the first fixing plate 51 so that the rotating body 31 remains in surface contact with the first fixing plate 51 when rotating relative to the first fixing plate 51. This can effectively increase work stability, and reduce the problem of uneven force due to a reduced contact area and a locally over-concentrated pressure during rotation, thus greatly increasing the strength of the second rotating mechanism, such that the work device can carry out operations under a high load or impact force.

Referring to FIG. 6, in some embodiments, the second rotating mechanism 30 further includes a rotating pin shaft 32. The rotating pin shaft 32 is fixedly connected to the rotating body 31 by means of a locking pin 33, so that the rotating body 31 is caused to rotate by rotation of the rotating pin shaft 32. The pressing mechanism includes a plurality of pressing pin shafts 71 and a plurality of pressing oil cylinders 72. The plurality of pressing pin shafts 71 are all connected to the rotating pin shaft 32. The plurality of pressing oil cylinders 72 are located on a side of the top plate 11 of the turntable body 10 away from the rotating body 31 and are respectively connected to the plurality of pressing pin shafts 71, and are configured to respectively cause the plurality of pressing pin shafts 71 to move by movement of piston rods, so that the rotating pin shaft 32 applies an acting force toward the first fixing plate 51 on the rotating body 31, through the locking pin 33.

As can be seen in FIG. 6, cylinder barrels of the pressing oil cylinder 72 can be inserted into the top plate 11 and fixed to the top plate 11, and ends of the piston rods 621 of the pressing oil cylinders 72 face directly toward an end 321 of the rotating pin shaft 32. The end 321 has a larger cross-sectional size than that of a portion of the rotating pin shaft 32 located in the mounting hole, and can be configured as a disc-shaped flange, so that the piston rods 621 of the plurality of pressing oil cylinders 72 can all apply a pressure to the rotating pin shaft 32 downward by pressing against the end 321, such that the rotating body abuts relatively tightly against the first fixing plate 51, to ensure a surface contact fit of a large area when the rotating body and the first fixing plate 51 slide relative to each other.

Referring to FIG. 7, in some other embodiments, the rotating body 31 includes a rotating seat 311, the rotating seat 311 has a bottom in surface contact with the first fixing plate 51, and the bottom of the rotating seat 311 has a circumferential flange 311*a*. The pressing mechanism includes oil cylinder mounting brackets 73 and a plurality of pressing oil cylinders 72. The oil cylinder mounting brackets 73 are arranged on the top plate 11 of the turntable body 10. The plurality of pressing oil cylinders 72 are mounted on the oil cylinder mounting brackets 73 and are configured to press the circumferential flange 311*a* downward by movement of piston rods.

As can be seen in FIG. 7, cylinder barrels of the pressing oil cylinders 72 can be arranged on the oil cylinder mounting brackets 73 located on an upper side of the top plate 11. The oil cylinder mounting bracket 73 can be configured as a bent plate, a portion of which is fixedly connected to a part of the top plate 11 outside the circumferential flange 311*a* of the rotating seat 311, and another portion of which extends to an inner side of the circumferential flange 311*a*. Ends of the piston rods of the pressing oil cylinders 72 face directly toward the circumferential flange 311*a*, and can apply a pressing force to the circumferential flange 311*a* such that the rotating body abuts relatively tightly against the first fixing plate 51, to ensure a surface contact fit of a large area when the rotating body and the first fixing plate 51 slide relative to each other.

The two types of pressing mechanisms described above can be selected and provided according to factors such as the specific form of the rotating body or rotating pin shaft used, arrangements at upper and lower sides of the top plate 11, etc. In order to cause the pressing force applied by the pressing mechanism to be more uniform in a circumferential direction to avoid local over-concentration of force, in the above embodiments, the plurality of pressing oil cylinders 72 can be arranged at equal angular intervals along a circumferential direction of the turntable body 10. The number of the pressing oil cylinders 72 can be determined according to the size of the turntable body 10 and the pressing force to be applied. For example, 2, 3 or 4 pressing oil cylinders 72 are arranged at equal angular intervals in the circumferential direction.

Figure 8:
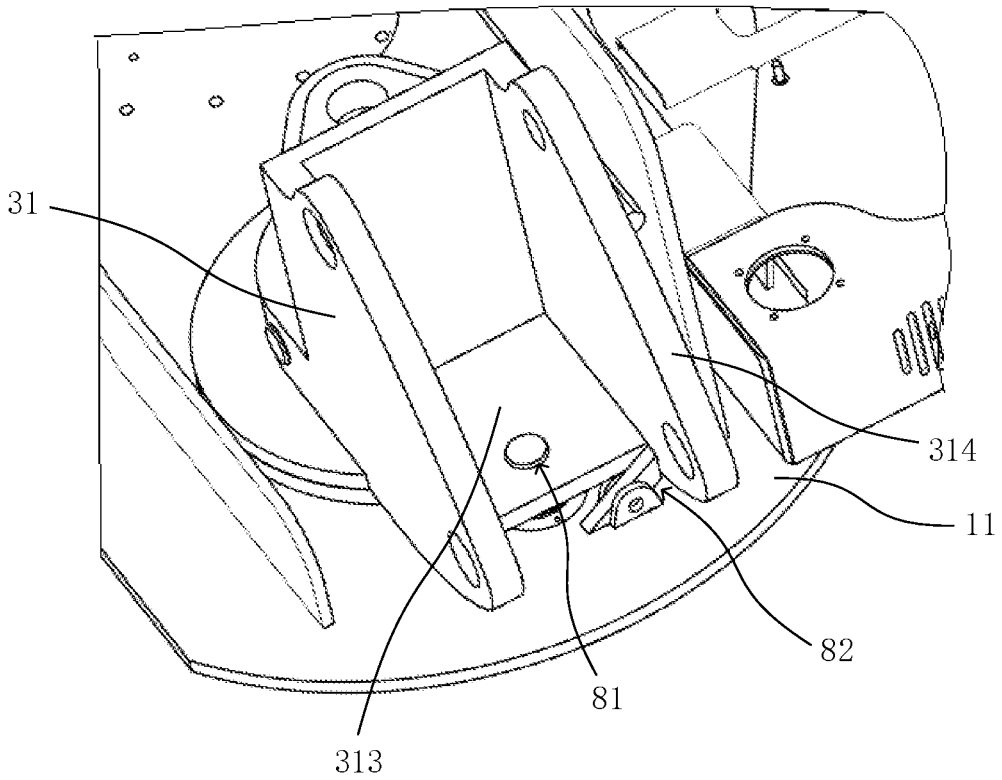
FIG. 8 is a structural diagram of a locking mechanism in some embodiments of a turntable assembly according to the present disclosure.
Figure 9:
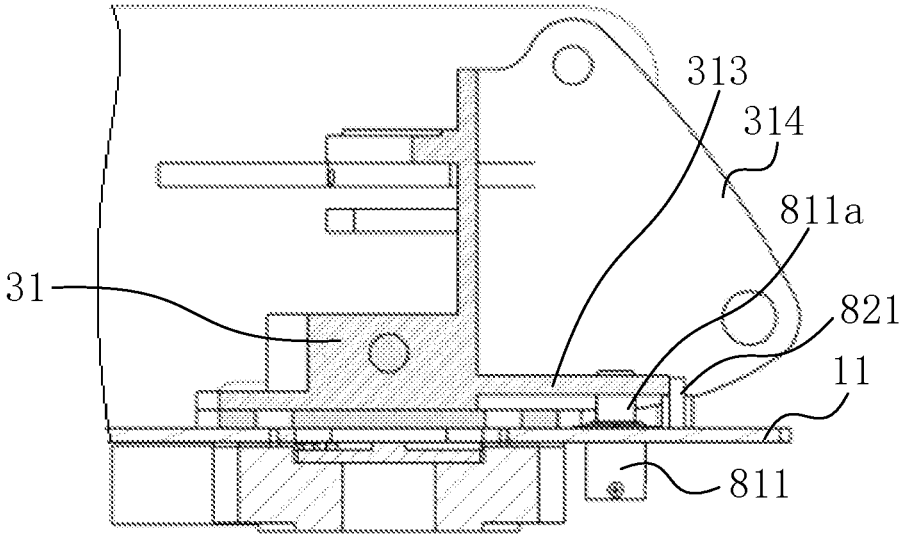
FIG. 9 is a structural diagram of a hydraulic oil cylinder locking mechanism in FIG. 8.
Figure 10:
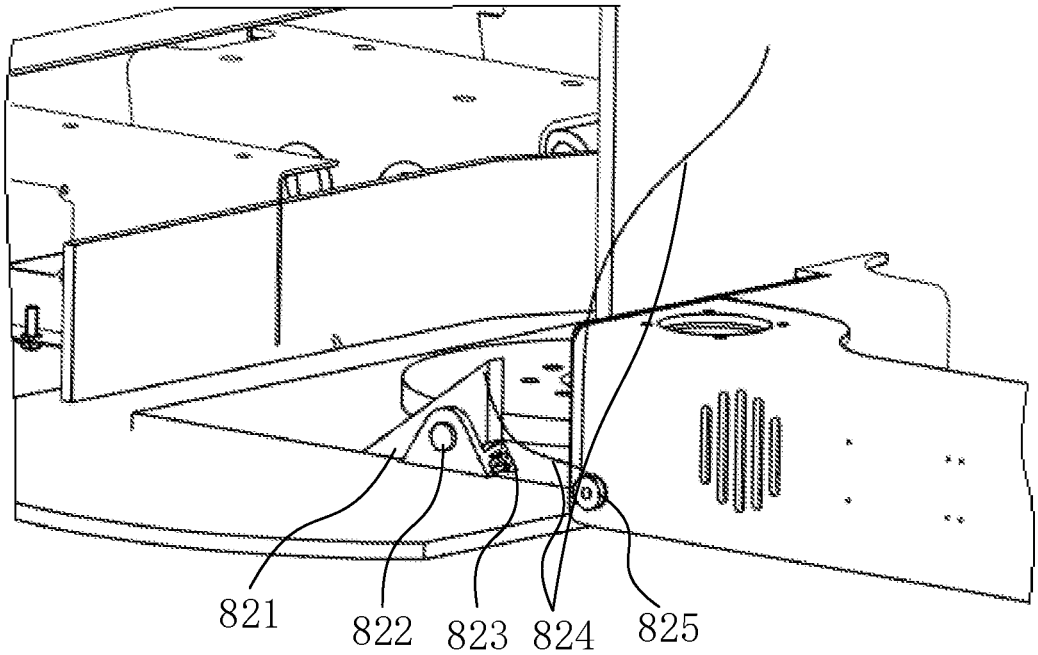
FIG. 10 is a structural diagram of a mechanical locking mechanism in FIG. 8.
Figure 11:
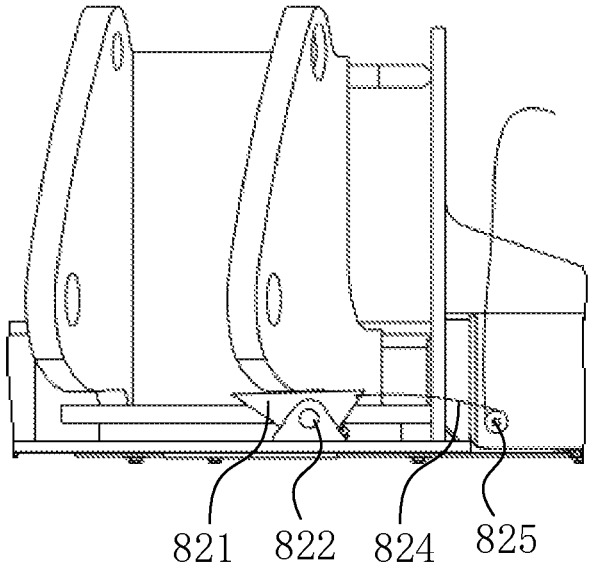
FIG. 11 is a schematic diagram of a locking plate in FIG. 10 in an unlocked position.

FIG. 8 is a structural diagram of a locking mechanism in some embodiments of a turntable assembly according to the present disclosure. FIG. 9 is a structural diagram of a hydraulic oil cylinder locking mechanism in FIG. 8. FIG. 10 is a structural diagram of a mechanical locking mechanism in FIG. 8. FIG. 11 is a schematic diagram of a locking plate in FIG. 10 in an unlocked position.

When the upper work device 40 needs to be kept in a certain position for operation and it needs to ensure the stability of its operation, therefore, referring to FIGS. 8 to 11, in some embodiments, the turntable assembly further includes a locking mechanism. The locking mechanism is arranged on the turntable body 10 and is configured to lock the rotating body 31 at at least one rotational position. Referring to FIG. 8, in some embodiments, the locking mechanism can include a hydraulic oil cylinder locking mechanism 81 and/or a mechanical locking mechanism 82. The turntable assembly can use a hydraulic oil cylinder locking mechanism 81 and a mechanical locking mechanism 82 to increase reliability and prevent an operating risk due to failure of any one of the locking mechanisms. In other embodiments, it is also possible to only use one of the hydraulic oil cylinder locking mechanism 81 and the mechanical locking mechanism 82.

Referring to FIG. 9, in some embodiments, the hydraulic oil cylinder locking mechanism 81 includes a locking oil cylinder 811 arranged on the side of the top plate 11 of the turntable body 10 away from the rotating body 31, and the rotating body 31 has at least one locking hole, and the locking oil cylinder 811 is configured to implement inserted fixation of the at least one locking hole by movement of a piston rod.

In FIG. 9, a cylinder barrel of the locking oil cylinder 811 is fixedly connected to the top plate 11, and the rotating body 31 has an extension plate 313 extending along a plane perpendicular to the axis of rotation, and one or more locking holes can be formed in the extension plate 313. The piston rod of the locking oil cylinder 811 can be extended or retracted relative to the cylinder barrel. When it is in a retracted state and not inserted into a locking hole, the rotating body 31 can rotate in a driven state, and when the piston rod is aligned with a certain locking hole, is extended and enters the locking hole, an effect of locking the rotating body is achieved.

Referring to FIGS. 8 to 11, in some embodiments, the mechanical locking mechanism 82 includes a locking plate 821, a spring 823, a fixing pin shaft 822, and a flexible shaft drawstring 824. The locking plate 821 is articulated to the top plate 11 by the fixing pin shaft 822, and the spring 823 is connected between the locking plate 821 and the top plate 11, for resetting the locking plate 821 to a position of abutting against the rotating body 31 to achieve positional locking of the rotating body 31.

The flexible shaft drawstring 824 is connected to the locking plate 821, for dragging the locking plate 821 to rotate around the fixing pin shaft 822 when subjected to a pulling force, so that the locking plate 821 leaves the position of abutting against the rotating body 31 to release the positional locking of the rotating body 31. When the flexible shaft drawstring 824 is not stressed, the spring 823 can keep the locking plate 821 at the position of abutting against the rotating body 31.

In FIGS. 8 and 9, the rotating body 31 has at least one vertical plate 314 parallel to the axis of rotation. The locking plate 821 can be configured as a triangular plate, one side of which can abut against a side of the vertical plate 314 to prevent the vertical plate 314 from rotating toward the fixing pin shaft 822. When an operator pulls the flexible shaft drawstring 824 manually or pulls the flexible shaft drawstring 824 by other device, the locking plate 821 is dragged to rotate around the fixing pin shaft 822 such that the locking plate 821 rotates to a position that does not restrict the vertical plate 314.

The turntable assembly in the above embodiments of the present disclosure can be used for large engineering mechanical equipment, such as cranes, excavators, backhoe loaders, etc., and can also be used for small multi-functional engineering machines. Therefore, an embodiment of the present disclosure further provides an engineering mechanical equipment including the turntable assembly described above. The engineering mechanical equipment can be an excavator, a crane or a backhoe loader.

At this point, embodiments of the present disclosure have been described in detail. To avoid obscuring the concept of the present disclosure, some details known in the art are not described. Based on the above description, those skilled in the art can fully understand how to implement the technical solutions disclosed herein.

Although some specific embodiments of the present disclosure have been described in detail by using examples, those skilled in the art should understand that the above examples are only for illustration and not for limiting the scope of the present disclosure. Those skilled in the art should understand that modifications to the above embodiments or equivalent substitutions to part of technical features can be made without departing from the scope and spirit of the present disclosure. The scope of the present disclosure is defined by the appended claims.

What is claimed is:

1. A turntable assembly for an engineering mechanical equipment, the turntable assembly comprising:

a turntable body;

a first rotating mechanism connected to the turntable body and configured to cause the turntable body to rotate relative to an undercarriage of the engineering mechanical equipment; and a second rotating mechanism connected to the turntable body and configured to cause an upper work device of the engineering mechanical equipment to rotate relative to the turntable body;

a first fixing plate located on a top plate of the turntable body and fixed relative to the turntable body;

a second fixing plate located on an upper side of the first fixing plate and fixed relative to the turntable body; and a pressing mechanism arranged on the turntable body and configured to press a rotating body against a surface of the first fixing plate so that the rotating body remains in surface contact with the first fixing plate when rotating relative to the first fixing plate, wherein an axis of rotation of the first rotating mechanism is not co-linear with an axis of rotation of the second rotating mechanism; wherein the second rotating mechanism comprises the rotating body for connecting the upper work device; and wherein at least two hinge points arranged spaced apart along the axis of rotation of the second rotating mechanism are provided between the rotating body and the turntable body; the rotating body is connected to the first fixing plate and the second fixing plate respectively by means of hinge shafts, and wherein the rotating body is in surface contact with the first fixing plate; and wherein one of:

(i) the second rotating mechanism further comprises a rotating pin shaft, which is fixedly connected to the rotating body by means of a locking pin, so that the rotating body is caused to rotate by rotation of the rotating pin shaft, and wherein the pressing mechanism comprises: a plurality of pressing pin shafts connected to the rotating pin shaft; and a plurality of pressing oil cylinders located on a side of the top plate of the turntable body away from the rotating body and respectively connected to the plurality of pressing pin shafts, and configured to respectively cause the plurality of pressing pin shafts to move by movement of piston rods, so that the rotating pin shaft applies an acting force toward the first fixing plate on the rotating body, through the locking pin; and (ii) the rotating body comprises a rotating seat, which has a bottom in surface contact with the first fixing plate, and a bottom of the rotating seat has a circumferential flange, wherein the pressing mechanism comprises: an oil cylinder mounting bracket arranged on the top plate of the turntable body; and a plurality of pressing oil cylinders mounted on the oil cylinder mounting bracket and configured to press the circumferential flange downward by movement of piston rods.

2. The turntable assembly according to claim 1, wherein the top plate has a first fixing hole, and the first fixing plate has a second fixing hole aligned with a center of the first fixing hole; and wherein the second rotating mechanism further comprises a rotating pin shaft, which passes through the first fixing hole and the second fixing hole and is fixedly connected to the rotating body by means of a locking pin, so that the rotating body is caused to rotate by rotation of the rotating pin shaft.

3. The turntable assembly according to claim 2, wherein the second rotating mechanism further comprises a slewing driver, which is located on a side of the top plate away from the first fixing plate, wherein a base of the slewing driver is fixedly connected to the first fixing plate or the top plate, and wherein a rotating bearing of the slewing driver is fixedly connected to the rotating pin shaft.

4. The turntable assembly according to claim 2, further comprising:

a first rib plate fixedly connected to the top plate; and a second rib plate fixedly connected to the top plate, wherein the first rib plate and second rib plate are located on two sides of the first fixing hole respectively.

5. The turntable assembly according to claim 4, wherein the second fixing plate is fixedly connected to a side wall of the first rib plate adjacent to the first fixing hole.

6. The turntable assembly according to claim 2, wherein the rotating body comprises:

a rotating seat having a mounting hole for inserting the rotating pin shaft and a bottom in surface contact with the first fixing plate; and paired lug plates formed integrally with the rotating seat, wherein the second fixing plate is located between the paired lug plates and is articulated to the paired lug plates.

7. The turntable assembly according to claim 6, wherein the bottom of the rotating seat has a circumferential flange, and wherein the diameter of the circumferential flange is larger than that of the first fixing plate.

8. The turntable assembly according to claim 1, wherein the first fixing plate is fixedly connected to the top plate.

9. The turntable assembly according to claim 1, wherein in case (i), the plurality of pressing oil cylinders are arranged at equal angular intervals along a circumferential direction of the turntable body.

10. The turntable assembly according to claim 1, further comprising:

a locking mechanism arranged on the turntable body and configured to lock the rotating body at at least one rotational position.

11. The turntable assembly according to claim 10, wherein the locking mechanism comprises at least one of a hydraulic oil cylinder locking mechanism and a mechanical locking mechanism.

12. The turntable assembly according to claim 11, wherein the hydraulic oil cylinder locking mechanism comprises a locking oil cylinder arranged on a side of the top plate of the turntable body away from the rotating body, wherein the rotating body has at least one locking hole, and wherein the locking oil cylinder is configured to implement inserted fixation of the at least one locking hole by movement of a piston rod.

13. The turntable assembly according to claim 11, wherein the mechanical locking mechanism comprises a locking plate, a spring, a fixing pin shaft and a flexible shaft drawstring, wherein the locking plate is articulated to the top plate by the fixing pin shaft, wherein the spring is connected between the locking plate and the top plate, for resetting the locking plate to a position of abutting against the rotating body to achieve positional locking of the rotating body, and wherein the flexible shaft drawstring is connected to the locking plate (821), for dragging the locking plate to rotate around the fixing pin shaft when subjected to a pulling force, so that the locking plate leaves the position of abutting against the rotating body to release the positional locking of the rotating body.

14. The turntable assembly according to claim 1, wherein a distance from the axis of rotation of the first rotating mechanism to a center of the turntable body is less than a distance from the axis of rotation of the second rotating mechanism to the center of the turntable body.

15. An engineering mechanical equipment comprising the turntable assembly of claim 1.

16. The engineering mechanical equipment according to claim 15, wherein the engineering mechanical equipment is an excavator, a crane, or a backhoe loader.

* * * * *